US005664300A

United States Patent [19]

Mizuno

[11] Patent Number: 5,664,300

[45] Date of Patent: Sep. 9, 1997

[54] AUTO-LOCK SLIDER FOR SLIDE FASTENER

[75] Inventor: Hiroshi Mizuno, Toyama-ken, Japan

[73] Assignee: YKK Corporation, Tokyo, Japan

[21] Appl. No.: 703,867

[22] Filed: Aug. 27, 1996

[30] Foreign Application Priority Data

Aug. 31, 1995 [JP] Japan ..... 7-223483

[51] Int. Cl.[6] ..... A44B 19/30

[52] U.S. Cl. ..... 24/424; 24/421

[58] Field of Search ..... 24/424, 421, 418, 24/420, 386, 387, 436

[56] References Cited

U.S. PATENT DOCUMENTS

| | | | |
|---|---|---|---|
| 3,813,736 | 6/1974 | Fukuroi | 24/424 |
| 4,048,699 | 9/1977 | Kanzaka | 24/421 |
| 4,102,022 | 7/1978 | Aoki | 24/424 |
| 4,287,646 | 9/1981 | Kanzaka | 24/424 |
| 4,667,376 | 5/1987 | Ishii et al. | 24/424 X |
| 5,152,036 | 10/1992 | Oda et al. | 24/424 |
| 5,195,221 | 3/1993 | Kanamaru et al. | 24/429 |

FOREIGN PATENT DOCUMENTS

| | | | |
|---|---|---|---|
| 141517 | 6/1951 | Australia | 24/424 |
| 56-22730 | 5/1981 | Japan . | |
| 58-100611 | 7/1983 | Japan . | |
| 62-41608 | 10/1987 | Japan . | |
| 4-32973 | 8/1992 | Japan . | |
| 97365 | 1/1961 | Norway | 24/424 |
| 853905 | 11/1960 | United Kingdom | 24/424 |
| 1496928 | 1/1978 | United Kingdom | 24/424 |

*Primary Examiner*—Peter M. Cuomo
*Assistant Examiner*—Robert J. Sandy
*Attorney, Agent, or Firm*—Hill, Steadman & Simpson

[57] ABSTRACT

In an auto-lock slider for a slide fastener, each of front and rear attachment lugs on a slider by has a provisional spring-holding ends in the form of a holding projection having in its top a V-shape groove, each lug having on opposite side surfaces a pair of guides and in its outer side base a pair of recesses. In assembly, a leaf spring having in its each end a cutout is placed on the two holding projections, whereupon these projections are clenched, by pressing, to provisionally hold the spring. At that time, a locking lever is supported on e slider body between the lugs to normally urge the locking lever to a slider locking position, and a pintle of a pull tab is disposed between the locking lever and the slider body for bringing the locking lever out of the slider locking position against the resilience of the leaf spring. Finally, the lugs, the spring, the pintle of the pull tab and part of the locking lever on the slider body are covered by a cover of which side walls are clenched against the four recesses of the lugs.

21 Claims, 8 Drawing Sheets

AUTO-LOCK SLIDER FOR SLIDE FASTENER

BACKGROUND OF THE INVENTION

1. Field of the Invention

This invention relates to a five-member auto-lock slider, for a slide fastener, composed of a slider body, a pull tab, a locking lever, a leaf spring and a cover, and more particularly to an auto-lock slider in which a leaf spring and a cover can be mounted in a stable form during the automatic assembling process of the slider.

2. Description of the Related Art

This type conventional auto-lock slide fastener slider is disclosed in Japanese Utility Model Laid-Open Publication No. Sho 58-100611. In this conventional auto-lock slider, as shown in FIG. 9, each of front and rear attachment lugs 113, 114 standing on the upper surface of an upper wing 106 of a slider body 101 has in its top surface a central recess 123, 123 in which each end of a leaf spring 104 is to be fitted. In assembling, the leaf spring 104 is placed over a locking lever 103 supported by the front and rear attachment lugs 113, 114, and then the leaf spring 104, the front and rear attachment lugs 113, 114 and part of the locking lever 103 on the upper wing 106 are covered by a cover 105 having on its inner wall surface a pair of projections (not shown) to be fitted in the respective recesses 123, 123 of the front and rear attachment lugs 113, 114.

FIG. 10 shows another conventional auto-lock slider which is disclosed in Japanese Utility Model Publication No. Sho 62-41608. In this conventional auto-lock slider, each of front and rear attachment lugs 213, 214 standing on an upper surface of an upper wing 206 of a slider body 201 has a projection 223 on which a cutout 235 in each end of a leaf spring 204 is to be threaded. In assembling, the leaf spring 204 are placed over a locking lever 203 supported by the front and rear attachment lugs 213, 214 in such a manner that the cutouts 235 in opposite ends of the leaf spring 204 are threaded on the corresponding projections 223 of the front and rear attachment lugs 213, 214, and then the leaf spring 204, the front and rear attachment lugs 213, 214, and part of the locking lever 203 are covered by a cover 205 having in its inner wall surface a pair of recesses (not shown) in which the projections 223 are to be fitted.

FIG. 11 shows still another conventional auto-lock slider which is disclosed in Japanese Utility Model Publication No. H4-32973. In this conventional auto-lock slider, a cover 305 has at one end a pair of first projections 313 extending from its inner wall surface and at the other end a second projection 314 having in its top a central V-shape groove. In assembling, one end of the leaf spring 304 is held by inwardly bending the first projections 313 with a cutout 335 of the other end of the leaf spring 304 being threaded on the second projection 314, whereupon the second projection 314 divided at its top by the V-groove is laterally and outwardly bent to hold the sides of the cutout 335. Then the cover 305 is fixedly attached to the upper surface of the slider body 301.

FIG. 12 shows a further conventional auto-lock slider which is disclosed in Japanese Utility Model Publication No. Sho 56-22730, in which front and rear pairs of laterally opposed triangular guide plates 413, 414 stand on the upper surface of a slider body 401 so that a cover 405 can be fitted on the guide plates 413, 415.

According to the first- and second-named prior art publications, the leaf spring 104, 204 is simply placed oil the front and rear attachment lugs 113, 114; 213, 214 on the upper surface of the upper wing 106, 206, whereupon the cover 105, 205 is attached to the front and rear attachment lugs 113, 114; 213, 214 to conceal the leaf spring 104, 204, the front and rear attachment lugs 113, 114: 213, 214 and part of the locking lever 103, 203 on the upper wing 106, 206. In the automatic assembling process, the pull tab 102, 202, the locking lever 103, 203, the leaf spring 104, 204 and the cover 105, 205 are placed successively on the slider body 101, 201 supported on a turn table of an automatic assembling machine, and finally the cover 105, 205, is clenched against the front and rear attachment lugs 113, 114; 213, 214. Since the individual parts are placed on the slider body 101, 201 without being fixed in the automatic assembling process and especially since the leaf spring 104, 204 is placed over the locking lever 103, 203, the leaf spring 104, 204 tends to fall off the locking lever 103, 203 due to the rotation of the turn table so that a high-speed rotation of the turn table cannot be realized, causing only a limited rate of production.

Further, since the leaf spring 104, 204 to be supplied to the automatic assembling machine is assembled as being severed from a continuous length of resilient strip which is originally wound on a spool, the leaf spring 104, 204 is originally warped even after severed so that it cannot be placed over the locking lever 103, 203 in a stable posture due to its warp. Therefore a high-speed operation of the automatic assembling machine cannot be achieved.

According to the third-named prior art publication, the leaf spring 304 is placed in the cover 305 positioned upside down, and then the cover 305 is reversed when attaching to the slider body 301, thus increasing the number of assembling steps so that an increased rate of production cannot be achieved. Accordingly the automatic assembling machine requires a further mechanism in order to reverse the cover 305, which is laborious and time-consuming.

According to the last-named prior art publication, since there exists no part for restricting the lateral displacement of the cover 405 on the slider body 401 in the automatic assembling process even if the cover 405 is supplied onto the slider body 401, it is difficult to position the cover 405 in place so that a quick supply of the cover 405 cannot be achieved. Therefore this conventional slider is not suitable for production by a high-speed automatic assembling machine.

SUMMARY OF THE INVENTION

It is therefore a first object of this invention to provide an auto-lock slider, for a slide fastener, in which a leaf spring can be mounted in a stable form and which enables a high-speed automatic assembling process and hence an improved rate of production.

A second object of the invention is to provide an auto-lock slider, for a slide fastener, in which a cover can be mounted stably in a predetermined position quickly and easily and then can be clenched easily and firmly against front and rear attachment lugs, thus realizing a high-speed automatic assembling process.

A third object of the invention is to provide an auto-lock slider, for a slide fastener, in which a leaf spring can be mounted on a slider body in a correct posture stably and easily and which is suitable for production by a high-speed automatic assembling process.

According to a first aspect of the invention, there is provided an auto-lock slider, for a slide fastener, comprising: a slider body composed of upper and lower wings joined at their front ends by a guide post, the upper wing having a locking-pawl insertion hole; front and rear attachment lugs projecting from an upper surface of the upper wing and terminating in front and rear provisional spring-holding ends; a leaf spring supported at front and rear ends thereof by the front and rear attachment lugs and provisionally held by the front and rear provisional spring-holding ends; a locking lever supported between the upper wing and the leaf spring and normally urged to a slider locking position by the leaf spring; a pull tab having a pintle supported between the upper wing and the locking lever for bringing the locking lever out of the slider locking position against the resiliency of the leaf spring; and a cover accommodating the front and rear attachment lugs, the leaf spring, part of the locking lever and part of the pull tab and having on its inside surface front and rear covering recesses in which the front and rear provisional spring-holding ends are covered.

The provisional spring-holding ends serve to hold the leaf spring in such a manner that the leaf spring can take a resilient action freely without being fixedly secured.

According to a second aspect of the invention, each of the front and rear attachment lugs has a pair of guides projecting integrally from opposite side surfaces and a pair of recesses in its outer side bases, the cover having in opposite side walls a pair of pintle-insertion cutouts laterally aligned with the guides, part of the side walls of the cover being clenched against such four recesses.

According to a third aspect of the invention, each of the front and rear provisional spring-holding ends is in the form of a holding projection having a central longitudinal V-shape groove in a top of the holding projection to divide the top of the holding projection into halves, the halves of the top of the holding projection being bendable outwardly by pressing, the leaf spring having in each of opposite ends a cutout in which the corresponding holding projection is to be received.

According to a fourth aspect of the invention, each of the front and rear provisional spring-holding ends is in the form of a pair of parallel spaced holding projections bendable inwardly by pressing, the leaf spring having on each of opposite ends a tongue to be received in the space between the holding projections.

According to a fifth aspect of the invention, each of the front and rear provisional spring-holding ends is in the form of a holding projection extending centrally from an outer end of the respective attachment lugs and bendable inwardly by pressing, the leaf spring having in each of opposite ends a central cutout in which the holding projection is to be received.

According to a sixth aspect of the invention, each of the front and rear provisional spring-holding ends is in the form of a central catch projection extending from an upper surface of each of the front and rear attachment lugs having a laterally enlarged head, the leaf spring having in each of opposite ends a central cutout through which the central catch projection is to be threaded in a snap action.

According to a seventh aspect of the invention, the front and rear provisional spring-holding ends are of any combination of:

(i) each of the front and rear provisional spring-holding ends being in the form of a holding projection having a central longitudinal V-shaped groove in a top of the holding projection to divide the top of the projection into halves, the halves of the top of the holding projection being bendable outwardly by pressing; the leaf spring having in each of opposite ends a cutout in which the corresponding holding projection is to be received;

ii) each of the front and rear provisional spring-holding ends being in the form of a pair of parallel spaced confronting holding projections bendable inwardly by pressing, the leaf spring having on each of opposite ends a tongue to be received in a space between each pair of the confronting holding projections;

iii) each of the front and rear provisional spring-holding ends being in the form of a central holding projection extending centrally from an outer end of the respective attachment lugs and bendable inwardly by pressing, the leaf spring having in each of opposite ends a central cutout in which the holding projection is to be received; and iv) each of the front and rear provisional spring-holding ends being in the form of a central catch projection extending from an upper surface of each of the front and rear attachment lugs and having a laterally enlarged head, the leaf spring having in each of opposite ends a central cutout through which the central catch projection is to be threaded in a snap action; the leaf spring being in the form associated with each of the combined forms of the front and rear provisional spring-holding ends.

DETAILED DESCRIPTION OF THE PREFERRED EMBODIMENT

Figure 1:
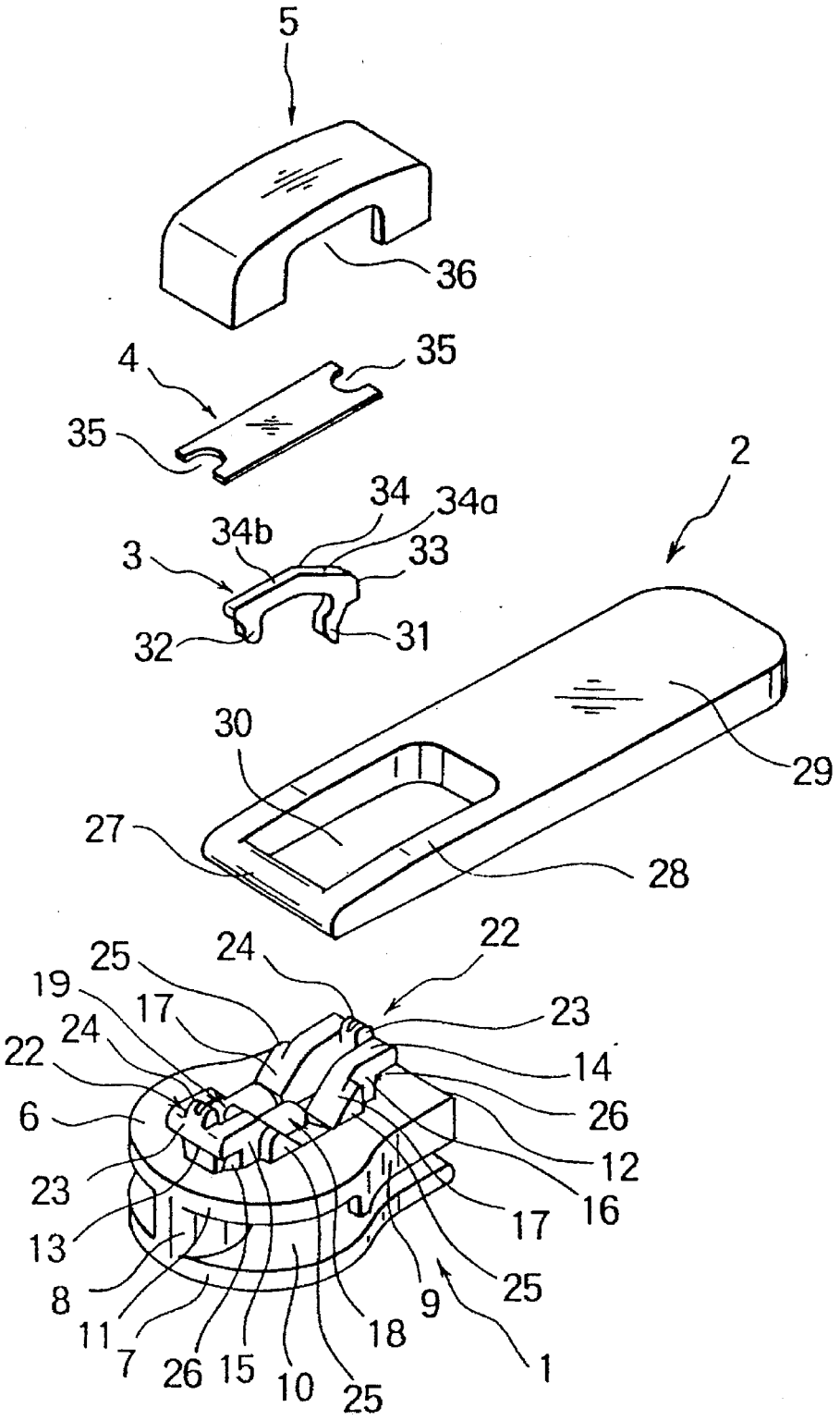
FIG. 1 an exploded perspective view of an auto-lock slider for a slide fastener, according to one embodiment of this invention.
Figure 2:
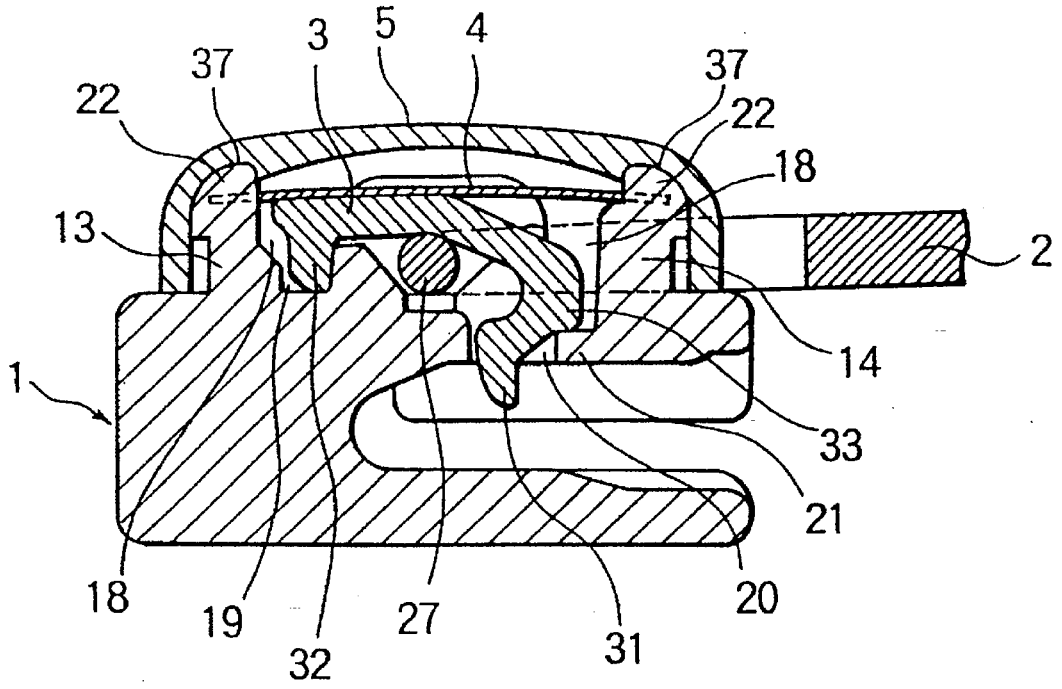
FIG. 2 is a longitudinal cross-sectional view of the slider of FIG. 1.
Figure 3:
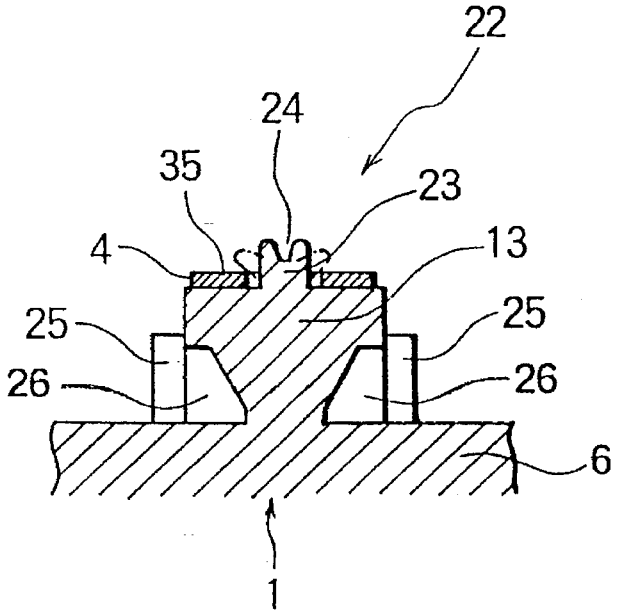
FIG. 3 is a fragmentary transverse cross-sectional view showing a provisional leaf-spring-holding mechanism of the slider.
Figure 4:
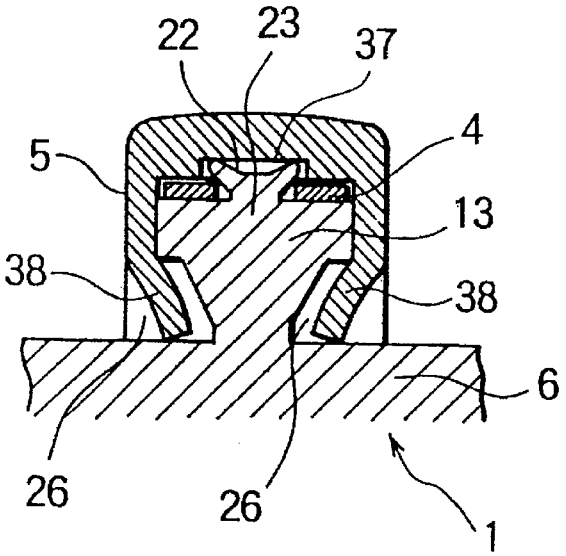
FIG. 4 is a fragmentary transverse cross-sectional view showing the manner in which a leaf spring of the slider is provisionally held and a cover is mounted on a slider body of the slider.

Principles of this invention are particularly useful when embodied in an auto-lock slider, for a slide fastener, as described in detail with reference to the accompanying drawings.

As shown in FIGS. 1 through 5, the auto-lock slider of this invention is a five-member form composed of a slider body 1, a pull tab 2, a locking lever 3, a leaf spring 4 and a cover 5.

The slider body 1 is composed of upper and lower wings 6, 7 joined at their front ends by a guide post 8, the upper wing 6 having at the respective opposite sides a pair of guide flanges 9. Thus the upper and lower wings 6, 7 define a guide channel 10 through which a pair of rows of fastener elements is to be guided.

On an upper surface of the upper wing 6, a front attachment lug 13 stands at a position toward a front end 11, and a rear attachment lug 14 stands at a position toward the rear end 12. The front and rear attachment lugs 13, 14 have the same width. Each of the front and rear attachment lugs 13, 14 has a generally C-shape opening inwardly confronting each other and includes a pair of opposite side walls 15, 16 which confronting surfaces are inclined as guide surfaces 17 for guiding a pintle 27 (described below) of the pull tab 2.

Between each pair of the opposite side walls 15, 16, a socket portion 18 for receiving the locking lever 3 is defined. Between the side walls 15 of the front attachment lug 13, a pivot recess 19 in which a pivotal end 32 of the locking lever 3 is to be engaged is defined. Between the side walls 16 of the rear attachment lug 14, the upper wing 6 has a locking-pawl insertion hole 20 through which a locking pawl 31 of the locking lever 3 is to be inserted to retractably project into the guide channel 10. The locking-pawl insertion hole 20 has at its rear end a stepped portion 21 to contact with a nose 33 of the locking lever 3 so that the extent to which the locking pawl 31 may project into the guide channel 10 is restricted.

Each of the front and rear attachment lugs 13, 14 has a flat upper surface suitable for supporting the leaf spring 4 and also a provisional spring-holding end 22 in the form of a holding projection 23 having centrally in its top a longitudinal V-shape groove 24 so that the thus divided top portions of the holding projection 23 can be easily clenched laterally and outwardly by pressing from the upper side.

Further, each attachment lug 13, 14 has on the outer surfaces of the opposite side walls 15, 16 a pair of guides 25 to be fitted in a pair of laterally aligned pintle-insertion cutouts 36 of the cover 5, which facilitates the attachment of the cover 5. In addition, each attachment lug 13, 14 has in its opposite outer bases a pair of recesses 26 against which the opposite side walls of the cover 5 are to be clenched for stablizing.

The pull tab 2 is in the form of a rectangular plate having at one end a pintle 27 to be disposed between the front and rear attachment lugs 13, 14 and at the other end a grip portion 29. Further, the pull tab 2 has a ring portion 28 defining jointly with the pintle 27 a rectangular opening 30 substantially equal in width and length with each attachment lug 13, 14.

The locking lever 3 is in the form of a generally C-shape plate having at one end a locking pawl and at the other end a pivotal end 32 and additionally having a nose 33 on its upper side toward the locking pawl 31. The locking pawl 31 is to be inserted through the locking-pawl insertion hole 20 to retractably project into the guide channel 10 as the locking lever 3 is pivotally movable about the pivotal end 32 engaged in the pivotal recess 19. The locking lever 3 has front and rear upper inclined surfaces 34*a*, 34*b*, at which central top is formed a top protuberance 34. The leaf spring 4 is supported on the inclined surface 34*b* as urging the locking lever 3 to pivotally move about the pivotal end 32. In response to the pivotal movement of the locking lever 3, the nose 33 comes into engagement with the stepped portion 21 of the locking-pawl insertion hole 20 so that the extent to which the locking pawl 31 projects into the guide channel 10 is restricted.

The leaf spring 4 is a rectangular resilient strip having a size such as to be mounted between the front and rear attachment lugs 13, 14 and also having in opposite ends a pair of identical U-shape cutouts 35 to be threaded on the respective holding projections 23 of the front and rear attachment lugs 13, 14 as the leaf spring 4 is supported on the upper flat surfaces of the front and rear attachment lugs 13, 14.

The cover 5 is in the form of a rectangular box with one open side, having in opposite side walls a pair of pintle-insertion cutouts 36 through which the pintle 27 of the pull tab 2 is to be threaded and in which the guides 25 of the front and rear attachment lugs 13, 14 are to be fitted. In the inner surface of its bottom side, the cover 5 has a pair of covering recesses 37 in which the corresponding holding projections 23 are to be fitted to protect the provisional spring-holding portions and to easily position the cover 5.

For assembling of the slider, the slider body 1 is placed on a turn table of an automatic assembling machine, and then the pull tab 2 is placed over the slider body 1 while then turn table is intermittently rotated at regular intervals. At that time, the opening 30 is threaded on the rear attachment lug 14 in such a manner that the pintle 27 of the pull tab 2 is positioned between the front and rear attachment lugs 13, 14. Then the locking lever 3 is supplied to the socket portion 18 over the pull tab 2 in such a manner that the locking pawl 31 is inserted through the locking-pawl insertion hole 20 while the pivotal end 32 is engaged in the pivotal recess 19. Then the leaf spring 4 is supplied over the locking lever 3 to lie on the upper flat surfaces of the front and rear attachment lugs 13, 14.

Figure 5:
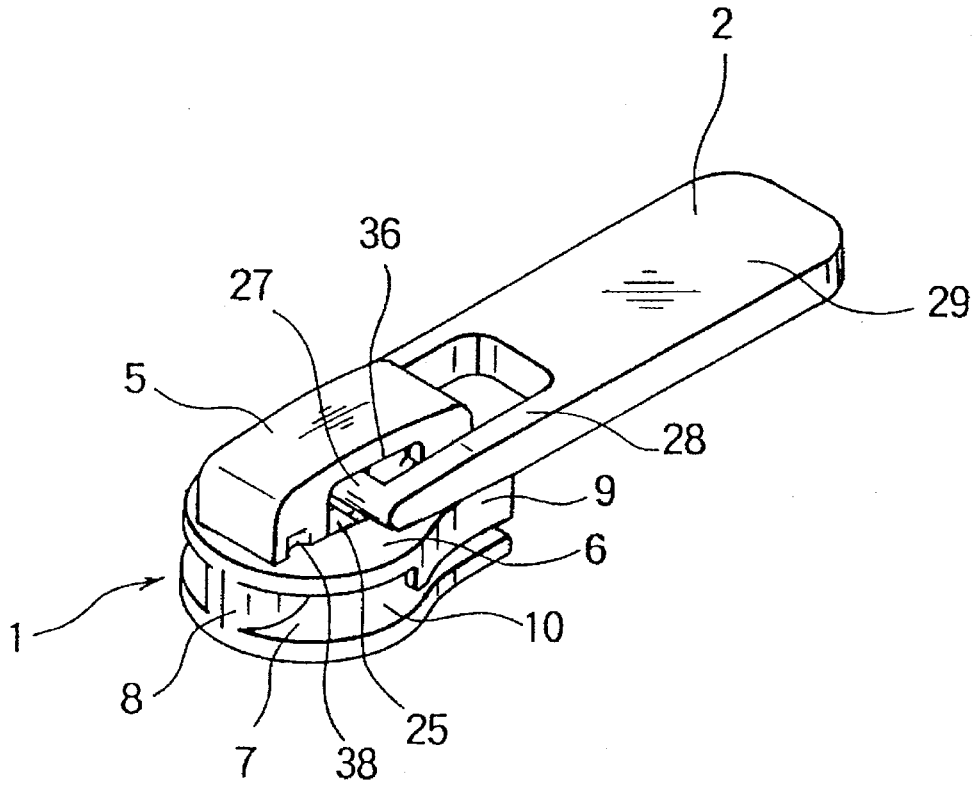
FIG. 5 is a perspective view showing the slider having been assembled.

After the cutouts 35 in its opposite ends of the leaf spring 4 are threaded on the corresponding holding projections 23 of the front and rear attachment lugs 13, 14, the leaf spring 4 is provisionally held by clenching the holding projections 23 by pressing from the upper side. Then the cover 5 is supplied over the leaf spring 4 as guided by the guides 25 of the front and rear attachment lugs 13, 14, whereupon the side walls of the cover 5 are clenched at portions 38 against the recesses 26 of the front and rear attachment lugs 13, 14. Thus the slider has been assembled as shown in FIG. 5.

Figure 6:
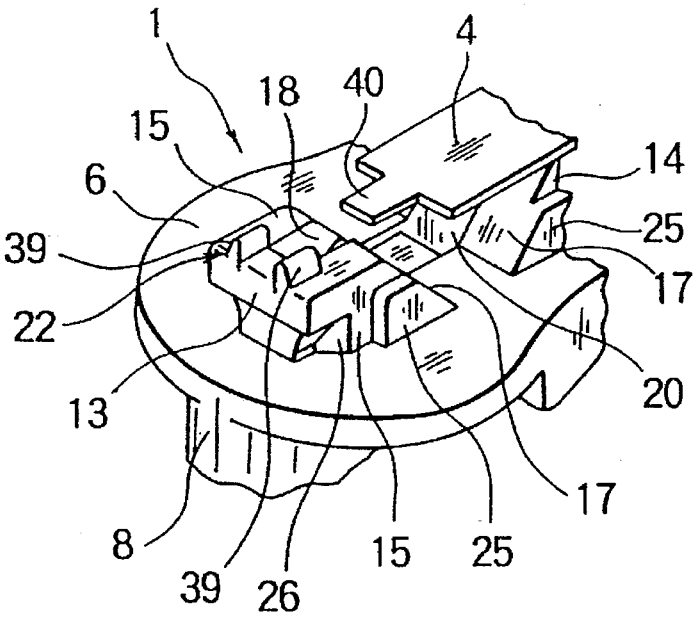
FIG. 6 is a fragmentary perspective view showing a first modification of the provisional leaf-spring-holding mechanism.

Following are various modifications of the provisional spring-holding ends of the front and rear attachment lugs 13, 14:

FIG. 6 shows a first modification of the provisional spring-holding end 22. In the this modification, the provisional spring-holding end 22 is in the form of a pair of confronting holding projections 39 extending centrally from the upper flat surface of the front attachment lug 13 and spaced apart transversely by a gap substantially equal to the width of the socket portion 18. The holding projections 39 are inwardly inclined at their outer surfaces and can be inwardly bent simply by pressing. The provisional spring-holding end 22 of the rear attachment lug 14 is identical in shape with that of the front attachment lug 13. The leaf spring 4 has on each end a tongue 40 to be received between the confronting holding projections 39.

Figure 7:
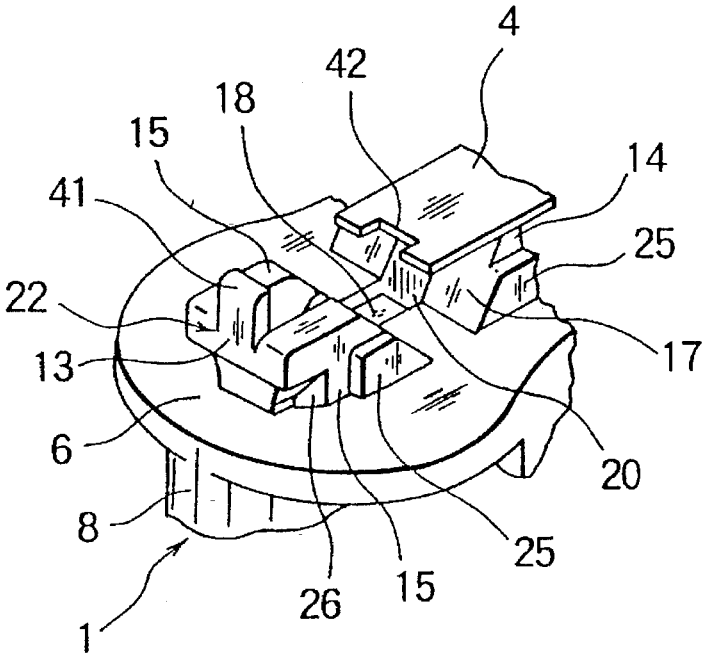
FIG. 7 is a fragmentary perspective view showing a second modification of the provisional leaf-spring-holding mechanism.

FIG. 7 shows a second modification of the provisional spring-holding end 22 in this modification, the provisional spring-holding end 22 is in the form of a central holding projection 41 extending centrally from the outer end of the upper flat surface of the front attachment lug 13 and having a slightly inwardly inclined outer surface and being inwardly bendable by pressing. The provisional spring-holding end 22 of the rear attachment lug 14 is identical in shape with that of the front attachment lug 13. The leaf spring 4 has in each end a cutout 42 to be threaded on the central holding projection 41.

Figure 8:
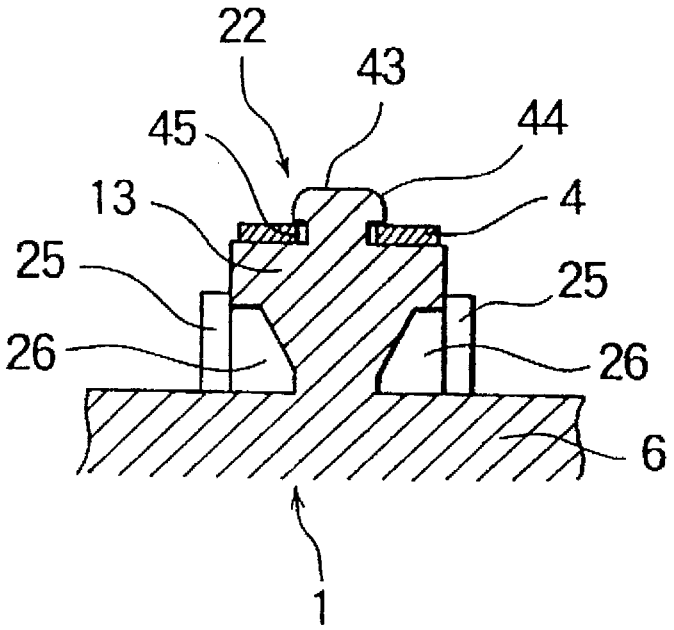
FIG. 8 is a fragmentary perspective view showing a third modification of the provisional leaf-spring-holding mechanism.
Figure 9:
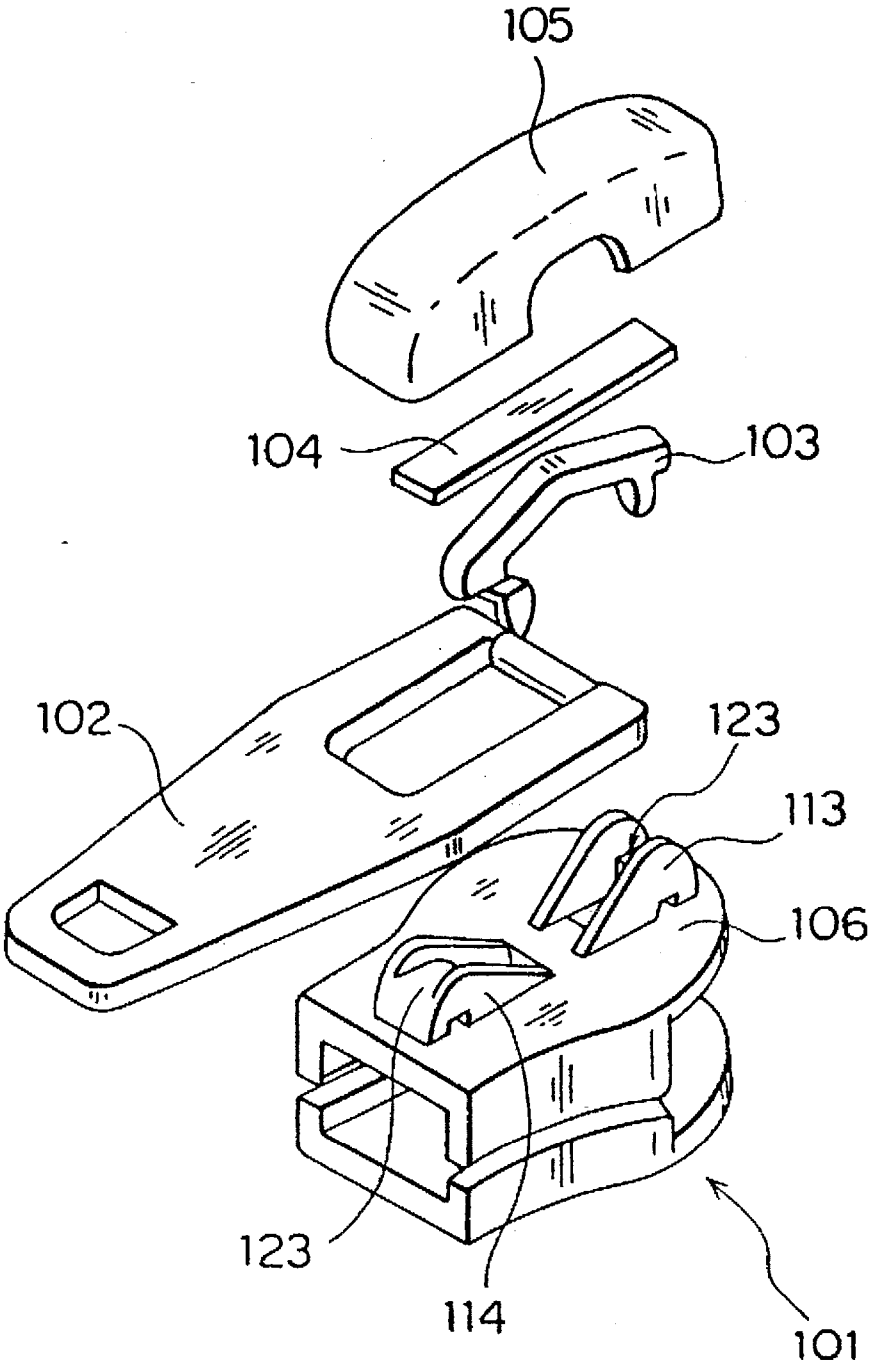
FIG. 9 PRIOR ART
FIG. 9 is an exploded perspective view of a conventional auto-lock slider, showing a known leaf-spring-holding mechanism.
Figure 10:
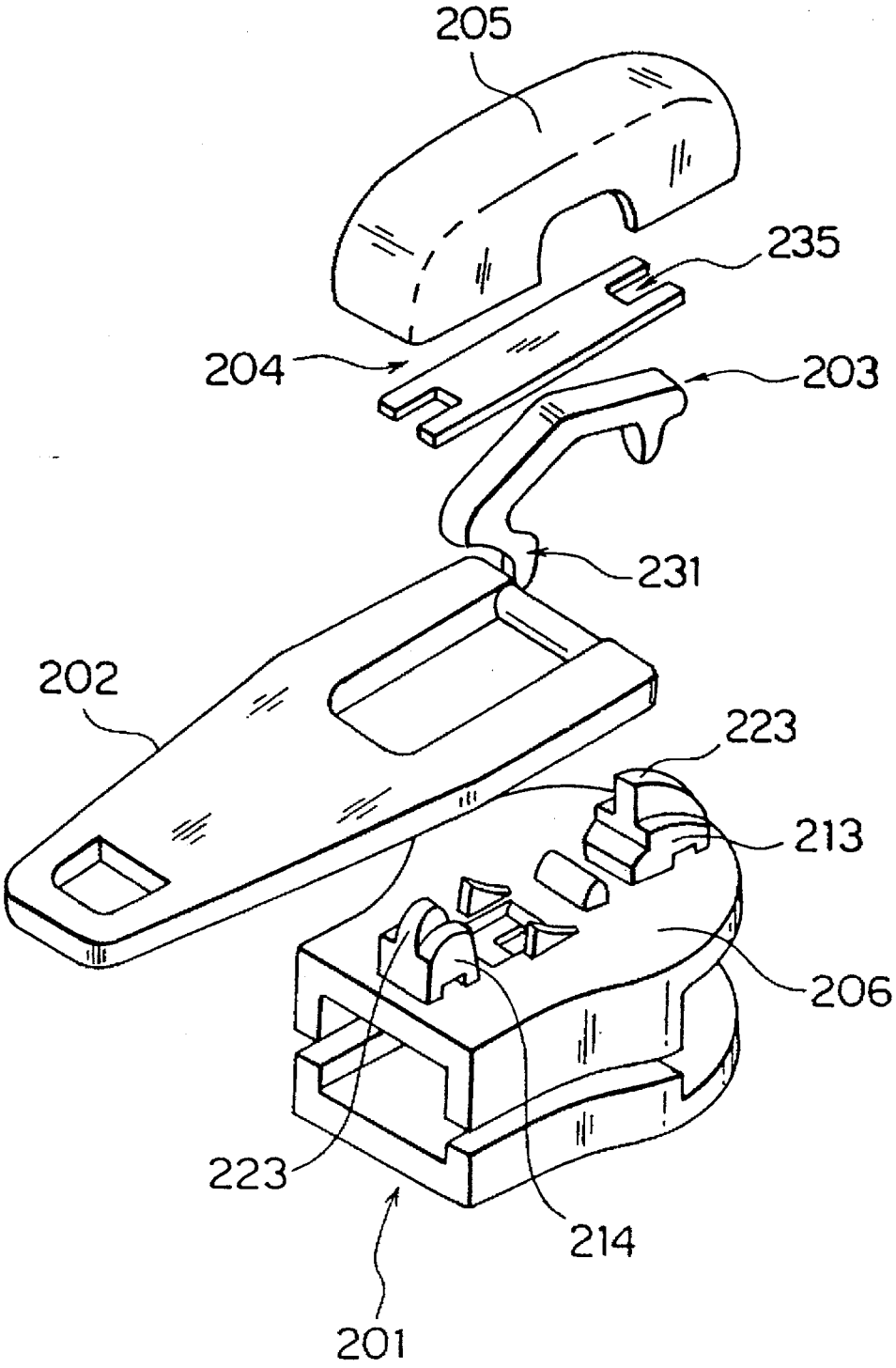
FIG. 10 PRIOR ART
FIG. 10 is an exploded perspective view of another conventional auto-lock slider, showing another known leaf-spring-holding mechanism.
Figure 11:
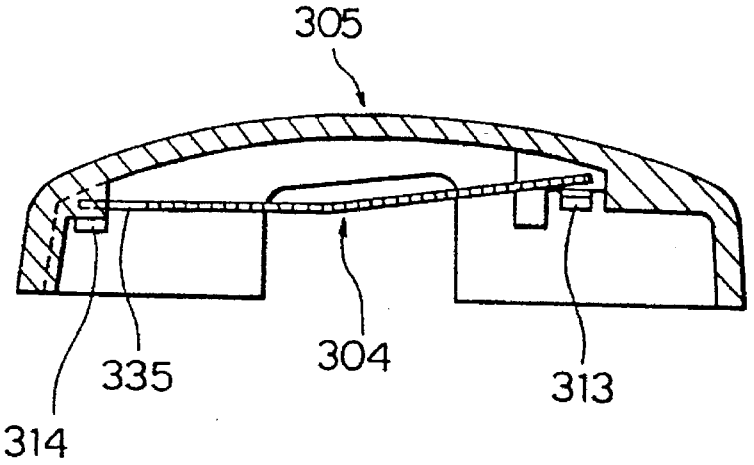
FIG. 11 PRIOR ART
FIG. 11 is an exploded perspective view of still another conventional auto-lock slider, showing still another known leaf-spring-holding mechanism.
Figure 12:
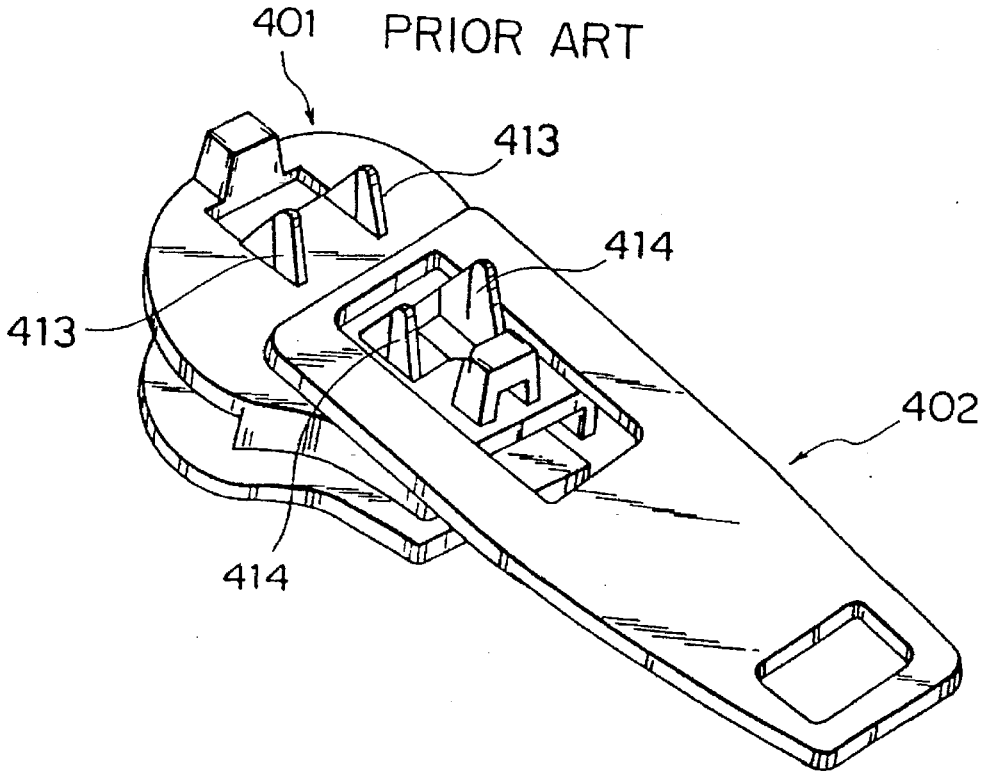
FIG. 12 PRIOR ART
FIG. 12 is a fragmentary exploded perspective view showing of a further conventional auto-lock slider.

FIG. 8 shows a third modification of the provisional spring-holding end 22. In the this modification, the provisional spring-holding end 22 is in the form of a catch projection 43 extending centrally from the upper flat surface of the front attachment lug 13, having a laterally enlarged head 44 which lower surface has a height substantially equal to the thickness of the leaf spring 4. The provisional spring-holding end 22 of the rear attachment lug 14 is identical in shape with that of the front attachment lug 13. The leaf spring 4 has in each end a cutout 45 slightly smaller in size than the enlarged head 44 so that the catch projection 43 can be fitted in the cutout 45 in a snap action by pressing the leaf spring 4 from the upper side.

In each of the foregoing modifications, the provisional spring-holding ends 22 of the front and rear attachment lugs 13, 14 have a common shape. Alternatively, the front and rear attachment lugs 13, 14 may have a combination of different forms of the provisional spring-holding ends 22. In another alternative form, similar provisional spring-holding ends may be arranged on both of the upper and lower wings to realize a double-faced auto-lock slider.

The auto-lock slider of this invention has the following advantageous results:

According to the auto-lock slider as defined in claim 1, partly since the leaf spring 4 is supported between the front and rear attachment lugs 13, 14 and partly since the leaf spring 4 can be provisionally held on the front and rear attachment lugs 13, 14 simultaneously with the supply of the leaf spring 4, it is possible to mount the leaf spring 4 on the slider body 1 stably without falling from the turn table of an automatic assembling machine even when it is operated at high speed, thus realizing a high-speed automatic assembling process and hence improving the rate of production.

Further, since the provisional spring-holding ends 22 of the front and rear attachment lugs 13, 14 are covered by the covering recesses 37 in the inner wall surface of the cover 5, it is possible to secure a reliable protection of the provisional spring-holding ends 22, thus guaranteeing a durable slider.

According to the auto-lock slider as defined in claim 2, partly since each attachment lug 13, 14 has on each of opposite sides an integral guide 25 and in its outer side base a pair of recesses 26, and partly since the cover 5 has a pair of laterally aligned pintle-insertion cutouts 36 to be fitted with the guides 25 and is clenched at opposite side walls against the recesses 26, it is possible to supply the cover 5 with respect to the slider body 1 quickly and easily with precision and also to position the cover 5 on the slider body 1 in a stable form, thus guaranteeing a high-speed automatic assembling process. Further, since the cover 5 can be mounted on the attachment lugs 13, 14 easily and firmly, it is possible to obtain a strongly built slider.

According to the auto-lock slider as defined in claims 3 through 7, partly since the provisional spring-holding end 22 of each attachment lug 13, 14 for provisionally holding the leaf spring 4 is in the form of a central holding projection 23 with a central V-shape groove in its top or in the form of a pair of laterally confronting holding projections 39 or in the form of a central projection 41, and partly since each end of the leaf spring 4 has a form associated with the provisional spring-holding end 22, it is possible to provisionally hold the leaf spring 4 on the attachment lugs 13, 14 simply by pressing from the upper side so that the leaf spring 4 can be mounted on the attachment lugs 13, 14 stably and easily, which requires only a simple mechanism for the automatic assembling machine.

Furthermore, since each attachment lug 13, 14 has a catch projection 43 with a laterally enlarged head 44 so that each end of the leaf spring 4 can be threaded on the catch projection 43 by a snap action, it is possible to provisionally hold the leaf spring 4 on the attachment lugs 13, 14 by pressing from the upper side and hence to mount the leaf spring 4 stably and easily using only a simple mechanism.

In an alternative form in which the provisional spring-holding ends 22 of the front and rear attachment lugs 13, 14 are different in shape from each other, since the leaf spring 4 can be provisionally held simply by pressing from the upper side, a wide selection for the provisional spring-holding ends 22 is possible, thus realizing a high-speed automatic assembling process with a simple mechanism.

What is claimed is:

1. An auto-lock slider, for a slide fastener, comprising:

(a) a slider body composed of upper and lower wings joined at their front ends by a guide post, said upper wing having a locking pawl insertion hole;

(b) front and rear attachment lugs projecting from an upper surface of said upper wing and terminating in front and rear provisional spring-holding ends;

(c) a leaf spring supported at front and rear ends thereof by said front and rear attachment lugs and provisionally held down on said front and rear attachment lugs by said front and rear provisional spring-holding ends;

(d) a locking lever supported between said upper wing and said leaf spring and normally urged to a slider locking position by said leaf spring;

(e) a pull tab having a pintle supported between said upper wing and said locking lever for bringing said locking lever out of said slider locking position against the resiliency of said leaf spring; and (f) a cover accommodating said front and rear attachment lugs, said leaf spring, part of said locking lever and part of said pull tab and having on an inside surface front and rear covering recesses in which said front and rear provisional spring-holding ends are covered.

2. An auto-lock slider, for a slide fastener, comprising:

(a) a slider body composed of upper and lower wings joined at their front ends by a guide post, said upper wing having a locking pawl insertion hole;

(b) front and rear attachment lugs projecting from an upper surface of said upper wing and terminating in front and rear provisional spring-holding ends;

(c) a leaf spring supported at front and rear ends thereof by said front and rear attachment lugs and provisionally held by said front and rear provisional spring-holding ends;

(d) a locking lever supported between said upper wing and said leaf spring and normally urged to a slider locking position by said leaf spring;

(e) a pull tab having a pintle supported between said upper wing and said locking lever for bringing said locking lever out of said slider locking position against the resiliency of said leaf spring; and (f) a cover accommodating said front and rear attachment lugs, said leaf spring, part of said locking lever and part of said pull tab and having on an inside surface front and rear covering recesses in which said front and rear provisional spring-holding ends are covered;

wherein each of said front and rear attachment lugs has a pair of guides projecting integrally from opposite side surfaces and a pair of recesses, said cover having in opposite side walls a pair of pintle-insertion cutouts laterally aligned with said guides, part of said side walls of said cover being clenched against such four recesses.

3. An auto-lock slider according to claim 1, wherein each of said front and rear provisional spring-holding ends is in the form of a holding projection having a central longitudinal V-shape groove in a top of said holding projection to divide said top of said projection into halves, said halves of said top of said holding projection being bendable outwardly by pressing, said leaf spring having in each of opposite ends a cutout in which the corresponding holding projection is to be received.

4. An auto-lock slider according to claim 1, wherein each of said front and rear provisional spring-holding ends is in the form of a pair of parallel spaced confronting holding projections bendable inwardly by pressing, said leaf spring having on each of opposite ends a tongue to be received in a space between each pair of said confronting holding projections.

5. An auto-lock slider according to claim 1, wherein each of said front and rear provisional spring-holding ends is in the form of a central holding projection extending centrally from an outer end of the respective attachment lugs and bendable inwardly by pressing, said leaf spring having in each of opposite ends a central cutout in which said holding projection is to be received.

6. An auto-lock slider, for a slide fastener comprising:

(a) a slider body composed of upper and lower wings joined at their front ends by a guide post, said upper wing having a locking pawl insertion hole;

(b) front and rear attachment lugs projecting from an upper surface of said upper wing and terminating in front and rear provisional spring-holding ends;

(c) a leaf spring supported at front and rear ends thereof by said front and rear attachment lugs and provisionally held by said front and rear provisional spring-holding ends;

(d) a locking lever supported between said upper wing and said leaf spring and normally urged to a slider locking position by said leaf spring;

(e) a pull tab having a pintle supported between said upper wing and said locking lever for bringing said locking lever out of said slider locking position against the resiliency of said leaf spring; and (f) a cover accommodating said front and rear attachment lugs, said leaf spring, part of said locking lever and part of said pull tab and having on an inside surface front and rear covering recesses in which said front and rear provisional spring-holding ends are covered;

wherein each of said front and rear provisional spring-holding ends is in the form of a central catch projection extending from an upper surface of each of said front and rear attachment lugs and having a laterally enlarged head, said leaf spring having in each of opposite ends a central cutout through which said central catch projection is to be threaded in a snap action.

7. An auto-lock slider according to claim 1, wherein each of said front and rear attachment lugs has a pair of guides projecting integrally from opposite side surfaces and a pair of recesses, said cover having in opposite side walls a pair of pintle-insertion cutouts laterally aligned with said guides, part of said side walls of said cover being clenched against such four recesses.

8. An auto-lock slider according to claim 3, wherein each of said front and rear attachment lugs has a pair of guides projecting integrally from opposite side surfaces and a pair of recesses, said cover having in opposite side walls a pair of pintle-insertion cutouts laterally aligned with said guides, part of said side walls of said cover being clenched against such four recesses.

9. An auto-lock slider according to claim 4, wherein each of said front and rear attachment lugs has a pair of guides projecting integrally from opposite side surfaces and a pair of recesses, said cover having in opposite side walls a pair of pintle-insertion cutouts laterally aligned with said guides, part of said side walls of said cover being clenched against such four recesses.

10. An auto-lock slider according to claim 5, wherein each of said front and rear attachment lugs has a pair of guides projecting integrally from opposite side surfaces and a pair of recesses, said cover having in opposite side walls a pair of pintle insertion cutouts laterally aligned with said guides, part of said side walls of said cover being clenched against such four recesses.

11. An auto-lock slider according to claim 6, wherein each of said front and rear attachment lugs has a pair of guides projecting integrally from opposite side surfaces and a pair of recesses, said cover having in opposite side walls a pair of pintle-insertion cutouts laterally aligned with said guides, part of said side walls of said cover being clenched against such four recesses.

12. An auto-lock slider, for a slide fastener, comprising:

(a) a slider body composed of upper and lower wings joined at their front ends by a guide post, said upper wing having a locking pawl insertion hole;

(b) front and rear attachment lugs projecting from an upper surface of said upper wing and terminating in front and rear provisional spring-holding ends;

(c) a leaf spring supported at front and rear ends thereof by said front and rear attachment lugs and provisionally held down on said front and rear attachment lugs by said front and rear provisional spring-holding ends;

(d) a locking lever supported between said upper wing and said leaf spring and normally urged to a slider locking position by said leaf spring;

(e) a pull tab having a pintle supported between said upper wing and said locking lever for bringing said locking lever out of said slider locking position against the resiliency of said leaf spring; and (f) a cover accommodating said front and rear attachment lugs, said leaf spring, part of said locking lever and part of said pull tab.

13. An auto-lock slider according to claim 12, wherein each of said front and rear attachment lugs has a pair of guides projecting integrally from opposite side surfaces and a pair of recesses, said cover having in opposite side walls a pair of pintle-insertion cutouts laterally aligned with said guides, part of said side walls of said cover being clenched against such four recesses.

14. An auto-lock slider according to claim 12, wherein each of said front and rear provisional spring-holding ends is in the form of a holding projection having a central longitudinal V-shape groove in a top of said holding projection to divide said top of said projection into halves, said halves of said top of said holding projection being bendable outwardly by pressing, said leaf spring having in each of opposite ends a cutout in which the corresponding holding projection is to be received.

15. An auto-lock slider according to claim 12, wherein each of said front and rear provisional spring-holding ends is in the form of a pair of parallel spaced confronting holding projections bendable inwardly by pressing, said leaf spring having on each of opposite ends a tongue to be received in a space between each pair of said confronting holding projections.

16. An auto-lock slider according to claim 12, wherein each of said front and rear provisional spring-holding ends is in the form of a central holding projection extending centrally from an outer end of the respective attachment lugs and bendable inwardly by pressing, said leaf spring having in each of opposite ends a central cutout in which said holding projection is to be received.

17. An auto-lock slider according to claim 12, wherein each of said front and rear provisional spring-holding ends is in the form of a central catch projection extending from an upper surface of each of said front and rear attachment lugs and having a laterally enlarged head, said leaf spring having in each of opposite ends a central cutout thorough which said central catch projection is to be threaded in a snap action.

18. An auto-lock slider according to claim 14, wherein each of said front and rear attachment lugs has a pair of guides projecting integrally from opposite side surfaces and a pair of recesses, said cover having in opposite side walls a pair of pintle-insertion cutout laterally aligned with said guides, part of said side walls of said cover being clenched against such four recesses.

19. An auto-lock slider according to claim 15, wherein each of said front and rear attachment lugs has a pair of guides projecting integrally from opposite side surfaces and a pair of recesses, said cover having in opposite side walls a pair of pintle-insertion cutouts laterally aligned with said guides, part of said side walls of said cover being clenched against such four recesses.

20. An auto-lock slider according to claim 16, wherein each of said front and rear attachment lugs has a pair of guides projecting integrally from opposite side surfaces and a pair of recesses, said cover having in opposite side walls a pair of pintle-insertion cutouts laterally aligned with said guides, part of said side walls of said cover being clenched against such four recesses.

21. An auto-lock slider according to claim 17, wherein each of said front and rear attachment lugs has a pair of guides projecting integrally from opposite side surfaces and a pair of recesses, said cover having in opposite side walls a pair pintle-insertion cutouts laterally aligned with said guides, part of said side walls of said cover being clenched against such four recesses.

* * * * *